United States Patent [19]

Bullivant

[11] Patent Number: 4,735,527

[45] Date of Patent: Apr. 5, 1988

[54] PILE SECTIONS

[75] Inventor: Roger A. Bullivant, Burton-on-Trent, England

[73] Assignee: Roger Bullivant of Texas, Inc., Grand Prairie, Tex.

[21] Appl. No.: 831,474

[22] Filed: Feb. 20, 1986

[30] Foreign Application Priority Data

Mar. 6, 1985 [GB] United Kingdom ..... 8505799

[51] Int. Cl.[4] ..... E02D 5/30

[52] U.S. Cl. ..... 405/232; 403/267; 405/252

[58] Field of Search ..... 405/231, 250, 251, 252, 405/256, 232; 403/265, 267

[56] References Cited

U.S. PATENT DOCUMENTS 2,065,507 12/1936 Alexander ..... 405/252

3,720,068 3/1973 De Rosa ..... 405/251 X 3,748,863 7/1973 Pogonowski et al. ..... 405/251 X 4,157,230 6/1979 Tomt et al. ..... 405/252

4,431,347 2/1984 Gillen ..... 405/251

FOREIGN PATENT DOCUMENTS 637620 5/1950 United Kingdom ..... 405/252

*Primary Examiner*—David H. Corbin

*Attorney, Agent, or Firm*—Richards, Harris, Medlock & Andrews

[57] ABSTRACT

A pile section for a sectional pile including a string of sections includes a concrete member (10) having at least one longitudinally reinforcing rod (12), the rod including a spigot (14) at one end and a socket (18) at the other which in use are adapted for permanent interconnection so that on driving one section against its neighbor a continuous reinforcing element is provided.

19 Claims, 2 Drawing Sheets

PILE SECTIONS

The present invention relates to pile sections. Especially but not exclusively, the present invention relates to concrete pile sections adapted to be driven in end-to-end relationship into the ground to form a continuous load-bearing pile.

According to the present invention there is provided a pile section comprising a concrete member including at least one reinforcing means extending generally coincident with or parallel to the longitudinal axis of the concrete member and provided with interconnecting means at each end adapted to locate and connect with corresponding interconnecting means provided at the ends of a reinforcing means of a similar pile section whereby when similar pile sections arranged in end-to-end relationship the interconnecting means resist movement of one section away from its neighbour.

According to another aspect of the invention there is provided a joint between pile sections including a disc of a reticular material which is at least partially collapsible as a result of force applied to the joint on pile driving and which has in its interstices an epoxy resin.

An embodiment of the present invention will now be described by way of example only with reference to the accompanying drawings, in which.

Figure 1:
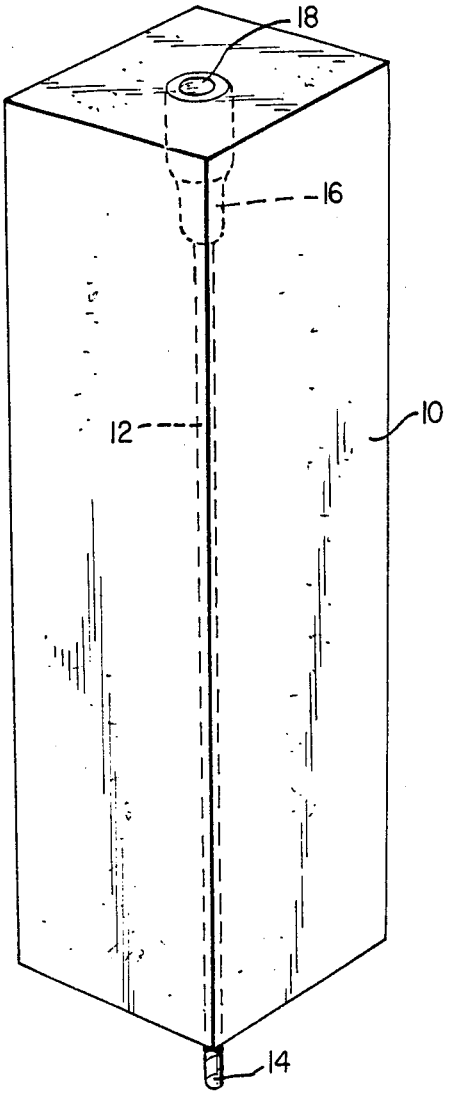
FIG. 1 shows a diagrammatic view of a section of a pile.

A sectional pile comprises a concrete member 10 of approximately 1 meter in length cast around a central steel reinforcing rod 12 which has integral helical deformations 13 formed thereon. The lower end of the rod projects beyond the base of the concrete member 10 to form a spigot 14, and a socket is provided at the other, upper end of the rod 12 by deforming a tube 16 over its lower portion such that it is permanently clamped to the upper end of the rod 12. The deformation leaves the upper end of the tube 16 undeformed with a socket 18 therein, the internal diameter of the socket being greater than the external diameter of the spigot 14 projecting from the base of the next above pile section. The internal surface of the socket is roughened, for example by a screw thread to increase the bonding characteristics.

In operation a pile section is driven into the ground and as its top is just about to disappear below ground level a further pile section is placed thereon with the spigot 14 in the socket 18. To ensure a rigid interconnection between the reinforcing bar of adjacent sections to give a continuous reinforcement throughout the multi-section pile an epoxy resin adhesive is introduced into the socket 18 prior to the introduction of the spigot 14 and when the resin sets a permanent joint between the socket 18 and the spigot 14 is provided.

The epoxy resin has a predetermined adhesive strength and the length of the protrusion of the spigot 14 into the socket 18 is chosen such that the bond between the spigot and socket after the epoxy has set is equal to or greater than the tensile strength of the rod 14. Similarly, the length of the deformed section of the tube 16 clamped around the top end of the bar 12 is chosen such that the strength of the tube/bar joint is greater than or equal to the tensile strength of the bar 12. It will be realised therefore that in a tensile test on a multi-section made-up reinforcement the bar will fail rather than the joint between the spigot and socket or the joint between the tube and the top of the bar.

Figure 3:
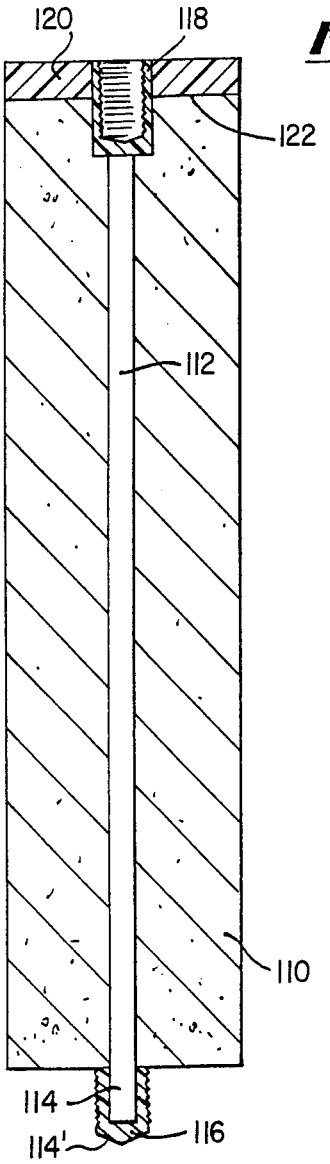
FIG. 3 shows a cross-section of a modified pile section.
Figure 4:
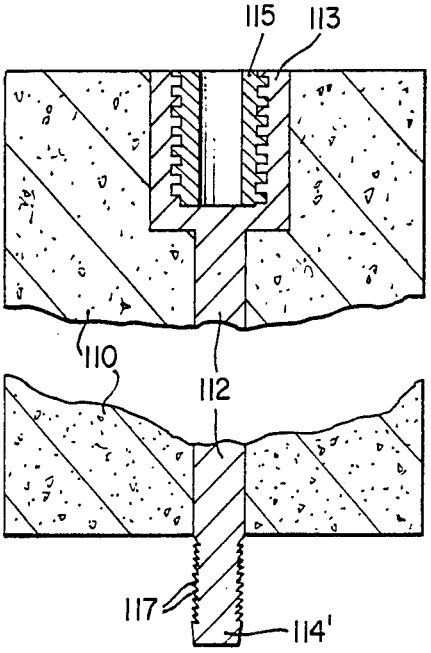
FIG. 4 shows the pile section of FIG. 7 on an enlarged scale.

A modified spigot and socket joint is shown in FIGS. 3 and 4.

A sectional pile comprises a concrete cylinder 110 of approximately 1 meter in length cast around a central steel reinforcing rod 112. The lower end 114 of the steel reinforcing rod has a high density plastics material cap 116 having a circumferentially ribbed outer profile and a conical lower end moulded thereon to define a spigot 114'. Permanently fixed to the upper end of the reinforcing rod 112, which terminates a distance from the upper end of the pile section, there is provided a high density plastics material hollow cylindrical socket 118, the inner cylindrical surface of which is ribbed to correspond with the ribs on the end cap 116. A relatively incompressible high strength plastics material disc 120 having a central aperture for the end cap 116 may be fitted across the top surface 122 of the pile section.

During a pile driving operation a pointed end piece having an end configuration similar to the top of the pile section described above is fitted to the lower end of a first pile section. The pile section and end piece are then driven into the ground by any suitable pile driving method and after a suitable penetration has been achieved the driving means are removed such that a second similar section can be placed on top of the first section with the cap 116 of the second pile section arranged at the entrance to the socket 118 of the first pile section. Pile driving is recommenced and the first movement of the second pile is a movement relative to the first pile to force the cap 116 into the socket 118 until the lower face of the concrete cylinder 110 of the second section abuts the disc 120 on the top of the first section. A positive interference fit is obtained between the socket 118 and cap 116 thereby effectively extending the length and action of the reinforcing rod 112 through the pair of end-to-end coupled pile sections. Further driving drives the pair of piles into the ground without any appreciable separation at the pile joint, the disc 120 accommodating whatever separation tends to take place and also shock loads which would normally be present if a concrete-to-concrete interface was present, such an interface tending to increase the risk of shattering due to direct impact loading. Pile driving continues by adding subsequent pile sections to the top of the pile until the desired length of pile is achieved.

In the modification shown in FIG. 4 a metal socket 113 is formed on the upper end of the reinforcing rod 112. The socket may be attached to the rod in the manner illustrated and described with reference to FIG. 2 but any suitable socket formation on the rod is appropriate. The socket has an internal thread whereby a high density plastics liner 115 can be threadably mounted within the socket. In this modification, the spigot 114' formed at the lower end of the pile section has sawtooth serrations 117, the outer diameter of which are greater than the internal diameter of the insert 115 so that when one pile section is placed on top of another with the spigot 114' in the socket 115 the pile driving operation will drive the spigot 114 into the socket and the serrations 117, on mating with the plastics liner 115, will form a permanent interference fit.

Figure 5:
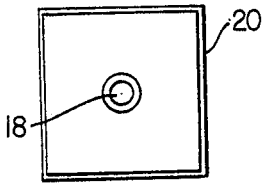
FIG. 5 shows a plan view of a top of a pile section.

In a further modified pile section of rectangular cross-section, with a view to avoiding the corners of the pile section breaking off during the driving operation as a result of impact loads, the upper and lower ends of the pile are provided during manufacture with a steel end sleeve 20, which may have a flanged upper end as shown in FIG. 5.

As the pile driver can never be certain, during a pile driving sequence, that one pile section is completely aligned with the other pile section, impact loads from the top section to the bottom section are often not transmitted over the entire facing faces of the pile sections but, if one section is at a slight angle to the other, impact loading is experienced on a corner of the pile. In view of the relative fragility of concrete under compression this often leads to fracture of the corner, the fracture extending progressively across the pile top. By eliminating corner contact as is possible with the FIG. 5 modification, this problem may be mitigated.

The problem may be further mitigated by arranging to cast into at least an upper portion of the pile section, as it is being formed, reinforcing fibres which may be crinkled metal strands, glass fibres or plastics material fibres, for example, polypropylene. Reinforcing rings or helixes may be cast around the reinforcing bar(s).

Figure 6:
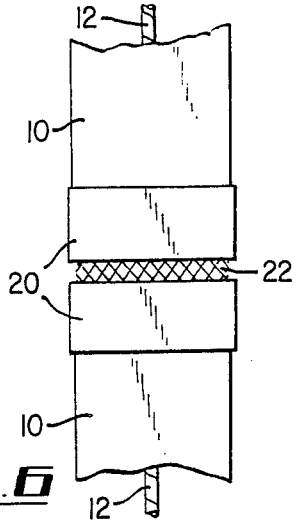
FIG. 6 shows a joint between two pile sections.

FIG. 6 shows the joint between two adjacent pile sections 10 each having end sleeves 20 as described with reference to FIG. 5. Each pile section has a spigot and socket joint of the type shown in FIGS. 1 and 2 or FIGS. 3 and 4, but for clarity, the spigot and socket joint has not been shown in FIG. 6. There is shown, however, a collapsible disc 22 between the pile sections. This disc is manufactured from an expanded metal mesh, for example EXPAMET (Registered Trade Mark). Meshes of this nature are formed by cutting slots in a metal sheet and deforming the sheet in areas of the slots by pressing certain portions thereof transversely of the plane of the sheet to form an expanded metal mesh having a thickness greater than the sheet from which it is formed. A sheet of this mesh having outside dimensions substantially equal to the outside dimensions of the end of the pile section is cut, a circular central hole being provided for passage of the spigot 14, (114') therethrough.

It will be realised that on compressing, the sheet 22 can take up certain sock loadings. Additionally, if one pile is driven at an angle slightly different from the other pile than one section of the sheet can compress more than the other sections to accommodate this angular deviation. In a pile driving operation the sheet 22, if subjected to repeated pile driving blows, will eventually reach a flattened condition where it is effectively a solid metal disc and its shock loading capabilities will be reduced or eliminated.

To avoid this problem and to incorporate a hydraulic buffer effect into the joint the interstices of the mesh are filled with an epoxy resin having sufficient viscosity to prevent them flowing out thereof even under shock loading. It will be realised therefore that before the resin sets effectively a plurality of hydraulic pockets are provided in the disc to give a shock absorbing effect, the epoxy resin in these pockets after the pile has been driven setting to provide a rigid interconnection between the pile sections which are, of course, adhered together by the epoxy resin.

The hydraulic cushioning effect can be increased by introducing an inert filler into the epoxy resin, conveniently the filler may be sand.

Prior to placing a sheet between the ends of pile sections it is preferable that these are primed by a suitable priming agent, for example more, unfilled epoxy resin.

Figure 2:
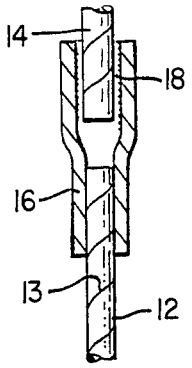
FIG. 2 shows a cross-sectional elevation of an interconnecting means between two pile sections.

Clearly the use of epoxy resin is most advantageous as this material has already been used, especially in the FIGS. 1 and 2 embodiment, to complete the spigot and socket joint.

I claim:

1. A pile comprising at least two sections arranged in end-to-end relationship, each section having a concrete member with at least one reinforcing means extending generally co-incident with or parallel to its longitudinal axis and provided with interconnecting means at the facing member ends, the interconnecting means of one member being adapted to locate and connect with the corresponding interconnecting means of the other member, a disc of reticular material being provided between the facing member ends, the disc being at least partially collapsible as a result of force applied on the driving, and a fluent material at the interstices of the disc which is hardenable after driving.

2. A pile as claimed in claim 1, in which the reinforcing means is a steel bar and the interconnecting means comprises a socket fixed to the steel bar at the upper end of a section and a spigot formed by or fixed to the lower end of the steel bar projecting beyond the base of the pile section, a clearance being provided between the spigot and socket to accommodate said fluent material which, after hardening, bands the spigot to the socket.

3. A pile as claimed in claim 1, in which the reinforcing means is a steel bar and the interconnecting means comprises a socket fixed to the steel bar at the upper end of a section and a spigot at the lower end of the bar projecting from the section, at least one of the spigot and socket being manufactured from a relatively rigid plastics material.

4. A pile as claimed in claim 1, in which the reinforcing means is a steel bar and the interconnecting means comprises a socket fixed to the steel bar at the upper end of a section and a spigot formed by the lower end of the bar projecting beyond the base of the section, the socket being provided with a rigid plastics material lining which is threaded into the socket.

5. A pile as claimed in claim 4, in which the end of the steel bar is serrated, the serrations having a saw-tooth form with the inclined faces of the saw teeth being inclined in the direction of insertion of the spigot into the lining.

6. A pile as claimed in claim 1, in which the filler is an epoxy resin.

7. A pile as claimed in claim 6, in which the resin has an inert filler mixed therethrough.

8. A pile as claimed in claim 7, in which the filler is sand.

9. A pile comprising at least two sections arranged in end-to-end relationship, each section having a concrete member with at least one reinforcing means extending generally co-incident with or parallel to its longitudinal axis and provided with positioning means at the facing member ends, the positioning means of one member being adapted to locate the corresponding positioning means of the other member, a sheet of reticular material having interstices therein positioned between the facing member ends, the sheet being at least partially collapsible as a result of force applied to the pile on driving, and a fluent material in the interstices of the sheet.

10. A pile as claimed in claim 9, in which the reinforcing means is a steel bar, and the interconnecting means comprises a socket fixed to the steel bar at the upper end of a section and a spigot formed by or fixed to the lower end of the steel bar projecting beyond the base of the pile section, a clearance being provided between the spigot and socket to accommodate said fluent material.

11. A pile as claimed in claim 9, in which the reinforcing means is a steel bar, and the interconnecting means comprises a socket fixed to the steel bar at the upper end of a section and a spigot at the lower end of the bar projecting from the section, at least one of the spigot and socket being manufactured from a relatively rigid plastics material.

12. A pile as claimed in claim 9, in which the reinforcing means is a steel bar, and the interconnecting means comprises a socket fixed to the steel bar at the upper end of a section and a spigot formed by the lower end of the bar projecting beyond the base of the section, the socket being provided with a rigid plastics material lining which is threaded into the socket.

13. A pile as claimed in claim 12, in which the end of the steel bar is serrated, the serrations having a saw-tooth form with the inclined faces of the saw teeth being inclined in the direction of insertion of the spigot into the lining.

14. A pile as claimed in claim 9, in which the filler is an epoxy resin.

15. A pile as claimed in claim 14, in which the resin has an inert filler mixed therethrough.

16. A pile as claimed in claim 15, in which the filler is sand.

17. A method of setting a plurality of concrete file sections into the ground in an end-to-end relationship, each section having a concrete member with at least one reinforcing means extending generally parallel to its longitudinal axis and provided with positioning means at the facing member ends, the positioning means of one member being adapted to locate the corresponding positioning means of the other member, comprising:

driving a first section into the ground such that its exposed end is near the ground level, positioning a sheet of reticular material having interstices therein on the exposed end of the first section, said sheet having a fluent material in the interstices therein which is hardenable after a predetermined period of time, positioning a second section in longitudinal alignment with the first section such that its positioning means engages the positioning means of the first section and with the reticular sheet between the abutting ends of the first and second sections, driving the second section along its longitudinal axis to force the first and second sections into the ground, the reticular sheet acting as an absorber of forces between the sections, and allowing the fluent material to harden to bond the ends of the sections one to the other.

18. The method of claim 17 further comprising:

mixing an inert filler in the fluent material.

19. The method as claimed in claim 17 further comprising:

forming the reinforcing means with a steel bar and the interconnecting means with a socket fixed to the steel bar at the upper end of a section, forming a spigot on the lower end of the steel bar projecting beyond the base of the pile section, a clearance being provided between the spigot and socket to accommodate said fluent material which, after hardening, bands the spigot to the socket.

* * * * *